US005172139A

United States Patent [19]

Sekiya et al.

[11] Patent Number: 5,172,139

[45] Date of Patent: Dec. 15, 1992

[54] LIQUID JET HEAD FOR GRADATION RECORDING

[75] Inventors: Takuro Sekiya; Takashi Kimura; Tomoaki Nakano, all of Yokohama, Japan

[73] Assignee: Ricoh Company, Ltd., Tokyo, Japan

[21] Appl. No.: 518,781

[22] Filed: May 4, 1990

[30] Foreign Application Priority Data

May 9, 1989 [JP] Japan ..... 1-115887

[51] Int. Cl.[5] ..... B41V 2/05

[52] U.S. Cl. ..... 346/140 R; 358/298

[58] Field of Search ..... 346/140 R; 358/298

[56] References Cited

U.S. PATENT DOCUMENTS 4,251,824 2/1981 Hara ..... 346/140
4,596,994 6/1986 Matsuda ..... 346/140
4,723,129 2/1988 Endo ..... 346/140 X
4,965,594 10/1990 Komuro ..... 346/140

FOREIGN PATENT DOCUMENTS 79171 6/1980 Japan .
124863 7/1984 Japan .
124864 7/1984 Japan .
124865 7/1984 Japan .

*Primary Examiner*—Joseph W. Hartary
*Attorney, Agent, or Firm*—Cooper & Dunham

[57] ABSTRACT

A liquid jet recording head which is used for generating bubbles in a writing liquid of a liquid chamber and discharging droplets of the writing liquid to a recording sheet in an ink-jet printer. The liquid jet recording head includes an orifice from which the writing liquid is discharged, a liquid discharge path leading to the orifice, the orifice communicating with the liquid chamber. The liquid jet recording head further includes a plurality of energy generating elements for generating energy to produce the bubbles in the writing liquid, the plurality of energy generating elements being provided within the liquid chamber and corresponding to a single orifice. Each of the energy generating elements has an energy transmitting surface which is approximately perpendicular to the liquid discharge path, and one or more combinations of the energy generating elements which are independently driven by the drive control mechanism to allow gradation recording on the recording sheet.

8 Claims, 5 Drawing Sheets

FIG. 1A
PRIOR ART
FIG. 1B
PRIOR ART
FIG. 1C
PRIOR ART
FIG. 1D
PRIOR ART
FIG. 1E
PRIOR ART
FIG. 1F
PRIOR ART
FIG. 1G
PRIOR ART
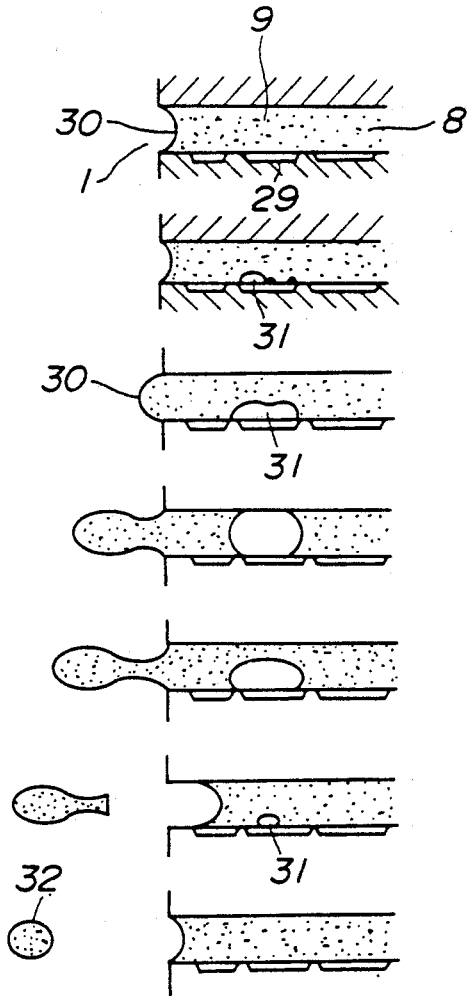
FIG. 2
PRIOR ART
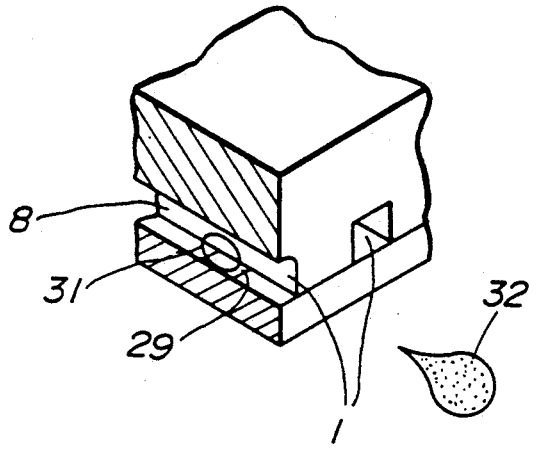

LIQUID JET HEAD FOR GRADATION RECORDING

BACKGROUND OF THE INVENTION

The present invention generally relates to liquid jet recording heads, and more particularly to a liquid jet recording head for carrying out gradation printing on a recording sheet in an ink jet printer.

Recently, much attention has been attracted to non-impact type recording methods because they have an advantage that noise during a printing operation can be reduced to a negligible degree. Among those methods, the so-called ink jet recording method is very helpful because this method makes it possible to perform high-speed recording with no need of using a special fixing process for ordinary recording sheets. Several ink jet recording methods which meet such an objective have been proposed up to now. Some of them have been put into practical use successfully as additional improvements have been made in the proposed methods, but others are still under development.

In the ink jet recording methods, recording is carried out by discharging a stream of droplets of a writing liquid or the ink, to deposit them on the recording sheet. These conventional methods are classified into four major categories according to the technique for generating a stream of ink droplets and the way to control the direction of the moving ink droplets generated.

The first category is the method (Teletype) disclosed, for example, in the specification of U.S. Pat. No. 3,060,429. This method electrostatically generates ink droplets and controls an electrical field applied to the droplets in accordance with recording signals, thus depositing selectively the writing liquid droplets on the recording sheet. More specifically, ink particles are accelerated in an electric field applied between an electrode and a discharge nozzle. Uniformly charged small ink droplets emerge from the nozzle, move across x-y deflection electrodes, and are deposited on the recording sheet while an electric field intensity is controlled, thus forming characters or symbols on the recording sheet. The deflection electrodes are provided to electrically control the movement of the uniformly charged droplet according to the recording signals.

The second method (Sweet) is disclosed, for example, in the U.S. Pat. Nos. 3,596,275 and 3,298,030. In this method, a continuous oscillation is used to generate ink droplets charged at a controlled level. Recording is carried out by shooting the charged ink droplets across the deflection electrodes where a uniform electric field is applied. More specifically, an orifice of a nozzle provided in a recording head provided with a piezoelectric element is disposed at a prescribed distance from the electrodes where recording signals are applied. The piezoelectric element is mechanically oscillated by applying electric signals at a given frequency to the element, allowing the ink droplets to be discharged from the orifice. The discharged ink droplets at the same time are charged by electrostatic induction to have an electric charge in accordance with the recording signals. The charged ink droplets are shot in a deflection direction when moving across the deflection electrodes between which a predetermined intensity of electric field is applied uniformly, so that only the ink droplets carrying the recording signals are deposited on the recording sheet.

The third method (Hertz) which is disclosed, for example, in the U.S. Pat. No. 3,416,153, carries out recording by generating vaporized ink particles through continuous oscillations due to an electric field applied between an annular charging electrode and a nozzle. The condition of vaporization of ink particles is controlled by intensity modulation of the electric field applied between the nozzle and the electrode in accordance with recording signals, thus accomplishing gradation recording.

Finally, the fourth method (Stemme) is disclosed, for example, in the U.S. Pat. No. 3,747,120. The principle of this method is different from those of the preceding three methods. The preceding three methods electrically control the movement of ink droplets discharged from a nozzle and selectively deposit the ink droplets carrying recording signals on the recording sheet. In comparison, the fourth method discharges writing liquid droplets from an orifice of a nozzle in accordance with recording signals to carry out the recording. More specifically, in this method, electrical recording signals are applied to a piezoelectric element provided in a recording head having a nozzle orifice through which writing liquid is discharged. The electrical signals are converted into mechanical vibrations of the piezoelectric element, and in accordance with the mechanical vibrations the record liquid droplets are discharged from the orifice to deposit them on the recording sheet.

While these four conventional methods each have some advantages, there are several unresolved problems they have.

The preceding three methods generate ink droplets directly by electrical energy and use an electric field control technique to control ink droplet deflection. Because of this, the first method provides a simple structure of the device but requires a very high voltage to generate ink droplets as well as has a difficulty in constructing a multi-nozzle recording head and is not helpful in performing high-speed recording.

The second method makes it possible to produce a multi-nozzle recording head and is useful for high-speed recording. However, it requires a complicated structure of the device and is highly difficult to electrically control the movement of ink droplets and often exhibits satellite dots on recording sheet.

The third method has an advantage that image recording with good gradation can be carried out with vaporized ink particles. However, it has a difficulty in controlling the condition of vaporized ink, often exhibits a problem with the recorded image, and is hard to produce a multi-nozzle recording head. This method therefore is not suitable for high-speed recording.

The fourth method provides relatively many advantages when compared to the preceding three methods. Major advantages of this method include a simple structure of the device, no need to recollect ink droplets being not used for image recording, and no necessity to use electrically conductive material as a writing liquid. Unlike the preceding three methods, the fourth method need not recollect ink droplets which are not used for image recording because it carries out the on-demand recording by discharging writing liquid from the nozzle only when a demand is presented. And the fourth method, unlike the first and second methods, has no necessity to select a conductive writing liquid and provides a flexibility in selecting a writing liquid material. However, the fourth method has a problem in manufacturing a recording head, and is very difficult to produce a compact piezoelectric element which has a desired resonant frequency. Therefore, it is hard to produce a multi-nozzle recording head of this type. Further, the fourth method is not suitable for high-speed because it utilizes mechanical vibration the piezoelectric element when ink droplets are discharged.

In view of the device structure, the high speed recording, the multi-nozzle construction, the satellite dot occurrence, the problem with image recording, etc., these conventional techniques can be adapted only to a limited range of the art in which the technique has advantages.

Some attempts for eliminating the above-described problems have been made in several improved recording techniques, which is disclosed, for example, in the Japanese published patent application no. 56-9429 by the same applicant. In this improved technique, the ink in the liquid chamber is heated to increase internal pressure of the ink, allowing the ink to be discharged from a capillary tube nozzle for recording on paper. There are several subsequent proposals for improvements to be made concerning the ink-jet recording technique.

Another technique is proposed, for example, in the Japanese published patent application no. 63-17624. According to the proposed technique, a plurality of heating elements are provided along a line in the writing liquid flow direction within the writing liquid passage leading to a single orifice. With such an improved structure, the proposed technique has a feature that the fartherest heating element from the orifice is first driven. This allows a saving in thermal energy for ink discharging and recording, a high speed recording capability and a long life of the device.

Another technique is disclosed, for example, in the Japanese published patent application no. 62-48585. According to the proposed technique, a plurality of electricity/heat conversion elements are provided in a liquid passage, wherein variable control is carried out to control the timings of drive signals being inputted to the control mechanism to control driving of the conversion elements, thereby performing graduation recording. Further, still another technique is proposed, for example, in the Japanese published patent application nos. 62-46358 and 62-46359. According to the former proposed technique, graduation image recording is carried out by driving a desired number of heating elements, selectively from among a plurality of heating elements provided at positions where writing liquid refilled to a liquid chamber is heated, in accordance with the level of signals carrying image information to be recorded. A conventional recording head which comprises a plurality of heating elements provided on a surface along a liquid discharge path leading to an orifice is proposed. However, since the relationship in location between the orifice and the heating element is not freely selectable, there are only a small number of variations of recording gradation available. According to the latter prior technique, a diameter of a discharge liquid droplet is varied by driving a single heating element, selectively from among a plurality of heating elements with different heating capacities provided at positions where writing liquid refilled to a liquid chamber is heated, in accordance with the level of signals carrying image information to be recorded.

Except for the Japanese published patent application no. 63-17624, graduation recording is a common objective of all the above-described prior art. However, all relate to a conventional type recording head which comprises a heating element provided along a liquid discharge path leading to an orifice. A simple structure of this type recording head having a single heating element corresponding to a single orifice can be formed into a small, highly integrated device and the characteristics of this type recording head are attainable. However, a multiple recording head of the above-described type which comprises a plurality of heating elements corresponding to a single orifice provided along a writing liquid discharge path leading to the orifice is difficult to be formed into a compact, highly integrated structure because a large number of control electrodes are required for controlling independently the heating elements, and therefore the original advantages of the recording head are not easily attainable. Also, in the case of such a recording head having several heating elements, only one or two heating elements which are provided at an appropriate distance from an orifice can serve to effectively generate energy for discharging ink droplets because only a small difference in distance between the heating element and the orifice has a great influence over the liquid discharge speed. The recording head of the conventional type therefore is not necessarily suitable for practical use. Further, in the case of such a recording head, the energy due to bubbles generated in the ink does not necessarily serve to effectively discharge the ink droplets.

Meanwhile, there is a still another gradation recording technique which is disclosed, for example, in the Japanese unexamined patent publication nos. 59-124863 and 59-124864. In this method, gradation recording is carried out by generating bubbles to discharge the writing liquid and by additionally generating bubbles for adjusting the ink discharge energy or by providing small openings at the discharge energy adjusting portion to vary the size of ink droplets produced. However, there is a problem in that it is difficult to match the bubble pressure generated by the main heating element with that generated by the adjusting heating element, because the main heating element is provided at a distance from the adjusting heating element for adjustment of the ink discharge energy. In addition, it is difficult to drive the adjusting heating element under stable operating conditions because the adjustment heating element is located at a closed place and fresh ink is not readily refilled to that place, thus resulting in a rise of the ink temperature there. Therefore, the proposed technique also does not necessarily achieve a desired gradation recording.

Further, another technique is disclosed, for example, in the Japanese unexamined patent publication no. 59-124865. According to the proposed technique, a plurality of ink droplet discharging members are provided for a single orifice, at least one of the members serving as an auxiliary member which provides reliability of the device. However, there is no concept of gradation recording in the disclosure.

As described above, none of the conventional techniques does not attain a desirable result of gradation recording, though several proposed methods are presented for providing a plurality of heating elements or for controlling the timings when the heating elements are driven to carry out gradation recording in a stable manner.

SUMMARY OF THE INVENTION

Accordingly, it is a general object of the invention to provide a novel and useful liquid jet recording head in which the above-described problems are eliminated.

Another and more specific object of the present invention is to provide a liquid jet recording head which will transmit effectively a discharging force from the bubbles to the ink droplets and enable the gradation recording to be made in stable operating conditions.

Still another object of the present invention is to provide a liquid jet recording head which will carry out gradation recording meeting the requirements for practical use.

The above-described objects of the present invention are achieved by a liquid jet recording head which comprises an orifice from which a writing liquid is discharged, a liquid discharge path leading to the orifice, the liquid discharge path and the orifice communicating with a liquid chamber, and a plurality of energy generating elements for generating energy to produce bubbles in the writing liquid. The plurality of energy generating elements correspond to the single orifice and are provided within the liquid chamber, the plurality of energy generating elements each having an energy transmitting surface which is approximately perpendicular to the liquid discharge path, and one or more combinations of the energy generating elements being independently driven by a drive control mechanism to allow graduation recording. According to the present invention, it is possible to make the operating conditions of the printer stable, and effectively transmit a discharge force from the bubbles to the ink droplets to carry out good gradation recording.

Other objects and further features of the present invention will be apparent from the following detailed description when read in conjunction with the accompanying drawings.

BRIEF DESCRIPTION OF THE DRAWINGS

FIGS. 1A through 1G are diagrams for explaining the principles of ink droplet discharging, bubble emerging and bubble disappearing in a conventional recording head for an ink-jet printer.

FIG. 2 is a perspective view of a recording head of the conventional type.

DESCRIPTION OF THE PREFERRED EMBODIMENTS

Figure 3:
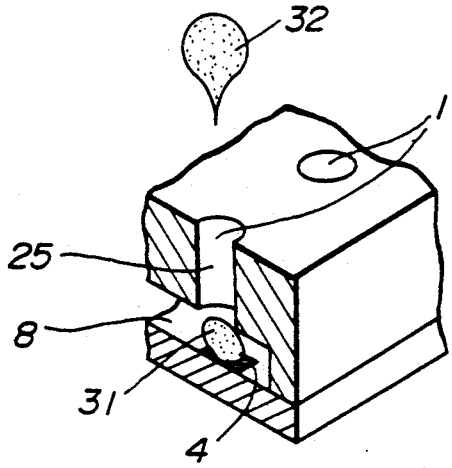
FIG. 3 is a perspective view of an embodiment of a liquid jet recording head according to the present invention.

Referring first to FIGS. 1A through 1G, a description will be given of the principle of ink droplet discharging due to bubbles emerging in a conventional recording head.

FIG. 1A shows a steady state of a writing liquid 30 within a nozzle 8, and a surface tension of the writing liquid 30 and an external pressure of the atmosphere are in equilibrium at an orifice 1 of the nozzle 8.

FIG. 1B shows a condition of the writing liquid 30 in which a temperature of a surrounding ink area 9 in the writing liquid around heaters 29 increases rapidly when thermal energy is generated by the heaters 29 and a boiling phenomenon occurs in the surrounding ink area 9. A number of small bubbles 31 appear from the surrounding ink area 9 adjacent to the heaters 29.

FIG. 1C shows a condition of the writing liquid 30 in which the writing liquid in the area 9 surrounding the heaters 29 is instantaneously vaporized and a boiling membrane is formed while the bubble 31 becomes greater. Liquid pressure within the nozzle 8 is increased and exceeds the external pressure at this time. The writing liquid 30 starts projecting from the orifice 1.

FIG. 1D shows a condition of the writing liquid 30 in which the bubble 31 grows to the maximum size, and the volume which the bubble 31 occupies allows a part of the writing liquid 30 to project from an end surface at the orifice 1. At this time, no electric current flows across the heaters 29, and the temperature of the surface around the heaters 29 is descending. The volume of the bubble 31 reaches the maximum slightly after the time when electrical drive pulses are applied.

FIG. 1E shows a condition of the writing liquid 30 in which the bubble 31 is cooled due to the surrounding ink and starts shrinking. The front part of the writing liquid 30 continues going forward at a discharge speed while the rear part returns back to the inside of the nozzle due to a decrease of internal pressure of the writing liquid 30 when the bubble 31 shrinks. And there appears a narrow part of the writing liquid.

FIG. 1F shows a condition of the writing liquid 30 in which the bubble 31 shrinks further and the writing liquid 30 comes into contact with the surface of the heaters 29 which is cooled to a lower temperature. The external pressure at the orifice 1 becomes higher than the liquid internal pressure, and a meniscus appears deeply in the nozzle. The front part of the moving writing liquid turns into a droplet 32 which is shot approximately at a velocity between 5 m/sec and 10 m/sec.

FIG. 1G shows a condition of the writing liquid 30 in which the writing liquid is refilled and returns back to the initial state shown in FIG. 1A. The bubble 31 completely disappears and the droplet 32 is moving.

FIG. 2 shows a conventional liquid jet recording head which comprises an orifice 1 and a heating element 29 provided along a liquid discharge path 8 leading to the orifice 1. This type of the recording head is hereinafter called an edge-shooter type. There appears a bubble 31 which is generated by the heating element 29, and a droplet 32 of the writing liquid which is shot from the nozzle 1.

Figure 4:
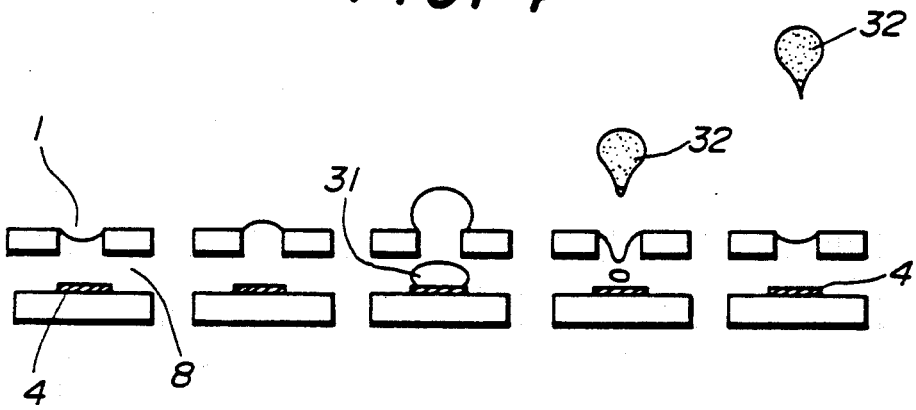
FIG. 4 is a diagram for explaining the principle of ink droplet discharge in a liquid jet recording head according to the present invention.

Next, a description will be given of an embodiment of a liquid jet recording head according to the present invention. FIG. 3 shows a liquid jet recording head of a different type which comprises an orifice 1 and a heating element 4 provided on a surface approximatey at right angles to an ink discharge path 25 leading to the orifice 1. On the surface where the heating element is provided, thermal energy is generated to produce a bubble 31 in the ink in a liquid chamber 8. As shown, an ink droplet 32 is shot from the orifice 1. The liquid jet recording head of this type is hereinafter referred to as a side-shooter type. FIG. 4 is a diagram for explaining the principle of ink droplet discharging in the side-shooter type liquid jet recording head. It is known that in comparison with the edge-shooter type recording head, the side-shooter type recording head provides a more effective transmission of a force due to bubbles generated, to the ink droplets which are shot to the recording sheet.

Figure 5:
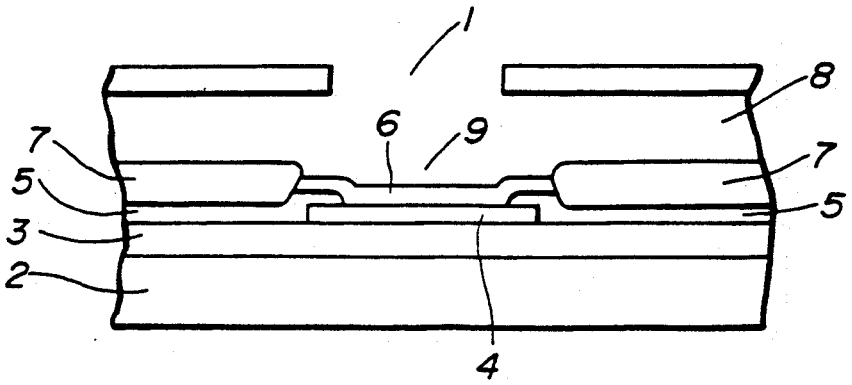
FIG. 5 is a sectional view of a liquid jet recording head having a bubble forming part 8 and an ink droplet discharge part 1.

FIG. 5 is a sectional view of a side-shooter type liquid jet recording head having a bubble forming part 9 and an ink droplet discharge part 1, which is designed to realize the above-described principle. The recording head generally comprises an orifice 1, a base 2, a heat regenerating layer 3, a heating element 4, an electrode 5, a protective layer 6, an electrode protecting layer 7, and a liquid chamber 8. The electrode 5 constitutes a part of a drive control mechanism (not shown). The drive control mechanism serves to control the driving of the heating element for generating thermal energy.

Useful materials which make up the heating element 4 include, for example, a mixture of tantalum and silicon dioxide, tantalum nitride, dichromate, silver-palladium alloy, silicon semiconductor, and a boride combined with a metal selected from among hafnium, lanthanum, zirconium, titanium, tantalum, tungsten, molybdenum, niobium, chromium, vanadium and the others.

Among these materials making up the heating element 4, a metal boride especially shows a good characteristic. Of the above described, hafnium boride exhibits the best characteristic as the heating element 4. And, zirconium boride, lanthanum boride, tantalum boride, vanadium boride, and niobium boride in this order show a better characteristic.

The heating element 4 can be formed with any of the above-described substances through an electron beam metalizing technique or sputtering technique. A film thickness of the heating element 4 is determined in accordance with the area of a heating element surface, the selected material, the shape and dimensions of the heat applying portion, and the power consumption on the actual surface so that a predetermined heat output per unit time is attained. A film thickness of the heating element 4 is normally between 0.001 microns and 5 microns, and preferably between 0.01 microns and 1 micron.

As a material which makes up the electrode 5, many of metals commonly used in the art can be employed. For example, aluminum, silver, gold, platinum, copper or the like is selectable for the electrode 5. Using any of these metals, the electrode 5 is formed at a predetermined position by a metalizing technique or the like so that it has a predetermined size, shape and thickness.

It is essential for the protecting layer 6 to protect the heating element 4 from influences of heat and the others without hindering an effective heat transmission from the heating element 4 to the writing ink. Useful materials which make up the protective layer 6 include, for example, silicon oxide, silicon nitride, magnesium oxide, aluminum oxide, tantalum oxide, zirconium oxide and the like. The protective layer can be formed with any of the above-described substances through an electron beam metalizing technique or sputtering technique. A film thickness of the protective layer 6 is determined normally in a range between 0.01 microns and 10 microns, and preferably in a range between 0.1 microns and 5 microns. The most suitable film thickness of the protective layer 6 is between 0.1 microns and 3 microns.

Figure 6A:
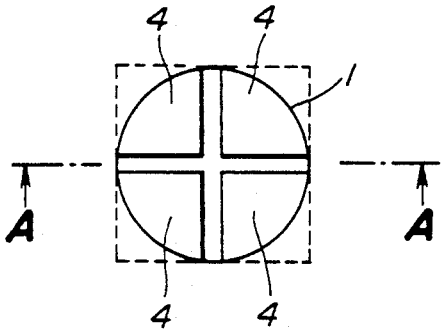
FIG. 6A is a plan view showing an embodiment of a liquid jet recording head according to the present invention.
Figure 6B:
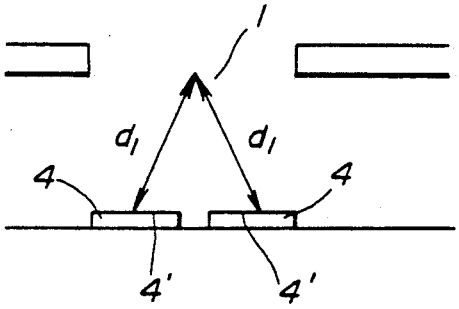
FIG. 6B is a sectional view taken along a line A—A in FIG. 6A.
Figures 7A, 7B, 7C, 7D:
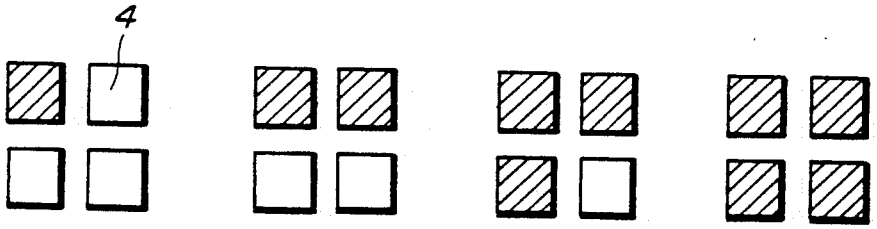
FIGS. 7A through 7D are diagrams for explaining combinations of driven heating elements.

FIG. 6A is a plan view showing an embodiment of a liquid jet recording head according to the present invention, and FIG. 6B is a sectional view taken along a line A—A in FIG. 6A. As shown, the liquid jet recording head according to the present invention comprises a generally circular orifice 1 and four heating elements 4 each having a generally rectangular shape. The four heating elements 4 each have a heat transmitting surface 4' approximately at right angles to an ink discharge path leading to the orifice 1. In the liquid jet recording head of the side-shooter type shown in FIGS. 6A and 6B, four heating elements 4 are provided for each single orifice 1, and the center of the four heating elements 4 is located approximately at the center of the orifice 1. It is possible that the heating elements 4 be independently driven by the drive control mechanism, and that all possible combinations of these four heating elements 4 be driven in accordance with a request concerning the gradation recording. This allows a varying size of ink droplets to be discharged from the nozzle.

Four heating elements 4 each have substantially the same thermal capacity, and it is possible to select any of four combinations of driven heating elements as shown in FIGS. 7A through 7D, for discharging ink droplets of a desired size. Shaded blocks shown in FIGS. 7A through 7D indicate driven heating elements. It is therefore possible that any of four grades of ink droplet size be selected for a desired graduation recording.

Figure 8A:
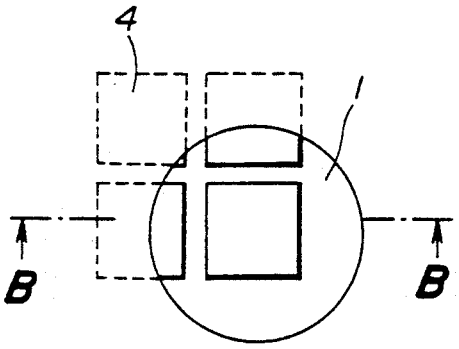
FIG. 8A is a plan view of another embodiment of a liquid jet recording head according to the present invention.
Figure 8B:
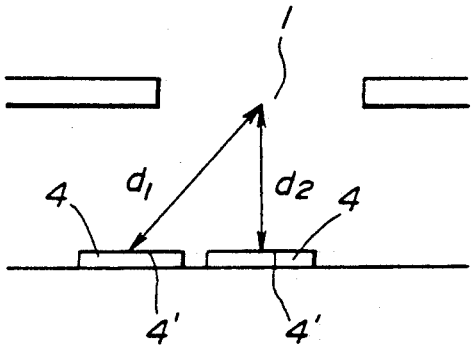
FIG. 8B is a sectional view taken along a line B—B in FIG. 8A.

FIG. 8A is a plan view showing another embodiment of a liquid jet recording head according to the present invention, and FIG. 8B is a sectional view taken along a line B—B in FIG. 8A. In this embodiment, four heating elements are provided at a position deviating from the center of the orifice 1. The center of the four heating elements having substantially the same thermal capacity deviates from the center of the orifice 1, so that distances d1, d2 from heat transmitting surfaces 4' of the heating elements 4 to the center of the orifice 1 are different. The size of ink droplets produced varies primarily depending on the distance from the surface 4' of the driven heating element 4 to the center of the orifice 1, although the four heating elements have substantially the same thermal capacity. It is possible to freely select any of fifteen combinations ($2^4$31 1) of driven heating elements for a desired ink droplet size.

In the above-described liquid jet recording head as shown in FIGS. 8A and 8B, the distances d1, d2 from the heat transmitting surfaces 4' of the heating elements 4 to the center of the orifice 1 are different. But, it is possible that, as shown in FIGS. 6A and 6B, the center of the four heating elements 4 be located approximately at the center of the orifice 1, and four heating elements 4 having different thermal capacities be provided, in order to obtain the similar results. There are some methods for making the thermal capacities of the heating elements different. One method is to change the voltage of input drive pulses to the drive control mechanism for achieving different thermal capacities of the heating elements. Another method for making the thermal capacities different is to change the width of the pulses for the respective heating elements for achieving the same purpose. Still another method is to perform pattern forming so as to form different sizes of the heating elements.

Accordingly, the present invention is not limited to the above-described embodiments in which four heating elements are provided. Generally, "n" pieces of heating elements which are capable of be independently driven by the drive control mechanism and have substantially the same thermal capacity are provided for a single orifice, and the distances from the heat transmitting surfaces 4' of the heating elements 4 to the center of the orifice 1 are different from one another to achieve a varying size of ink droplets. The selection from among $(2^n-1)$ combinations of driven heating elements can freely be made for a desired gradation recording. Otherwise, "n" pieces of heating elements which are capable of being driven independently and have different thermal capacities provided for a single orifice, and the distances from the surfaces 4, of the heating elements 4 to the center of the orifice 1 are substantially the same to achieve the same results.

However, it is to be noted that the number "n" of heating elements is not limitless but the maximum number in view from the practical use is eight. To make a greater number of steps of gradation available, it is desirable that several steps of the voltage of input drive pulses to control the driving of a single heating element or several steps of the width of the pulses be used rather than employing an increased number of heating elements. Or, it is desirable that the timings of the input pulses being sent to control the driving of the heating elements be changed to allow finely different bubble sizes to be produced in the case where different sizes of bubbles are formed with a plurality of heating elements.

As described in the foregoing, it is possible for the present invention to carry out gradation recording which meets the requirements for practical use, by selecting various combinations. In an edge-shooter type recording head, however, the relationship in location between the orifice and the heating element cannot freely be selected. The number of variations available is limited and a suitable gradation recording for practical use is not achieved. On the contrary, the side-shooter type recording head according to the present invention is useful to eliminate the difficulties of the edge-shooter type.

Figure 9A:
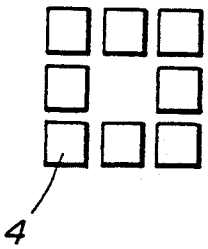
FIGS. 9A and 9B are schematic views of a liquid jet recording head having eight heating elements.
Figure 9B:
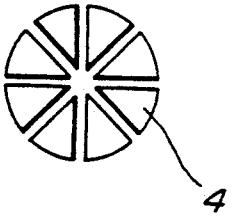
Figure 10A:
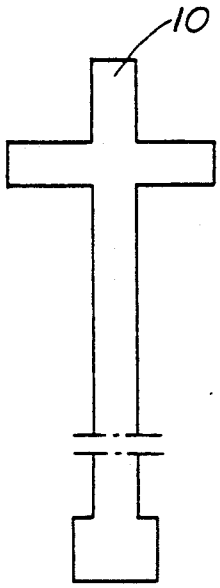
FIGS. 10A through 10D are diagrams for explaining the pattern forming procedure for heating elements, a protective layer and electrodes of a recording head.
Figure 10B:
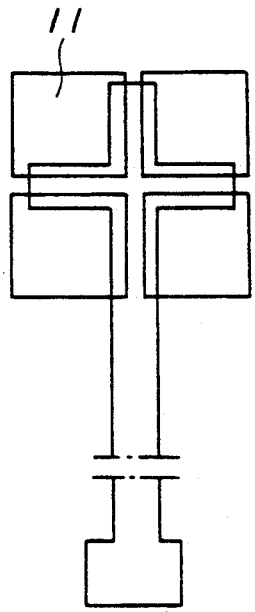
Figure 10C:
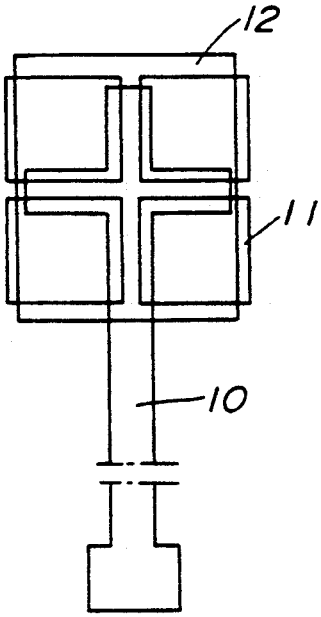
Figure 10D:
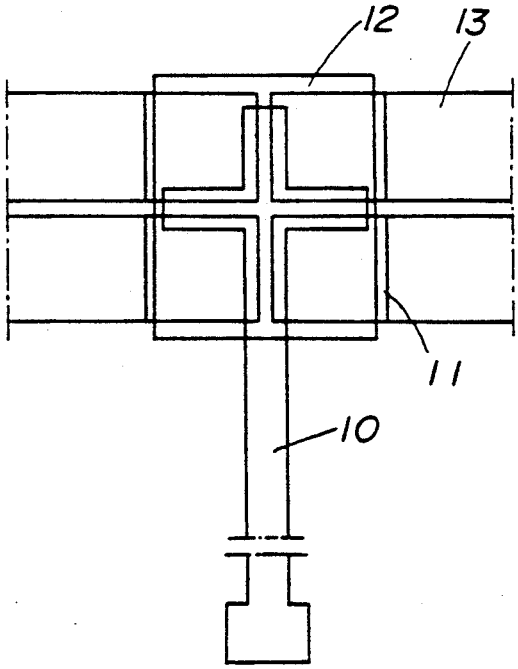

FIGS. 9A and 9B show another embodiments of a liquid jet recording head according to the present invention which has eight heating elements. The eight heating elements with a generally rectangular shape in FIG. 9A are arranged in three rows and three columns as shown, while the eight heating elements in FIG. 9B are provided to form generally eight segments of a circle.

FIGS. 10A through 10D show an example of the procedure for pattern forming of four heating elements for a liquid jet recording head. A common electrode 10, four heating elements 11, an insulation layer 12, and a control electrode 13 are formed by a suitable pattern forming technique as in FIGS. 10A, 10B, 10C and 10D, respectively. The common electrode 10 and the control electrode 13 constitute a part of the drive control mechanism. The drive control mechanism serves to control the driving of the heating elements 4 for generating thermal energy.

As described in the foregoing, it is possible for the present invention to construct a liquid jet recording head having a simple structure which carries out good gradation recording. If several factors including the number of heating elements, the distances from the heating elements to the orifice, the voltage of input drive pulses, the width of input drive pulses, the timing of input drive pulses being sent, etc., are combined appropriately, it is possible to achieve several tens or several hundreds of steps of gradation for recording, which meets the requirements for practical use.

Further, the present invention is not limited to these embodiments, but various variations and modifications may be made without departing from the scope of the present invention.

What is claimed is:

1. A liquid jet recording head for generating bubbles in a writing liquid and discharging droplets of the writing liquid to a recording sheet in a printer, said printer having a drive control mechanism for driving the liquid jet recording head, said liquid jet recording head comprising:

an orifice through which the writing liquid is discharged:

a liquid chamber having a liquid discharge path leading to the orifice, said liquid chamber communicating with said liquid discharge path and said orifice to allow the writing liquid within the liquid chamber to be discharged from the orifice through said liquid discharge path; and a plurality of heating elements provided within the liquid chamber for generating thermal energy to produce bubbles in the writing liquid, said heating elements having a heat transmitting surface which is perpendicular to said liquid discharge path, said heating elements having different thermal energy generating capacities and having substantially the same distance from the center of said orifice, said heating elements being provided corresponding to said single orifice and arranged in a plane within said heat transmitting surface, each of said heating elements being driven independently of the others by the drive control mechanism to generate independently thermal energy used for discharging the writing liquid, selected combinations of said plurality of heating elements being selectively driven so that various sizes of droplets of the writing liquid are discharged through said orifice.

2. The liquid jet recording head as claimed in claim 1, wherein said heating elements have generally rectangular shapes and are arranged on said energy transmitting surface generally in two or more rows and two or more columns.

3. The liquid jet recording head as claimed in claim 1, wherein said heating elements are arranged on said energy transmitting surface in the form of segments of a circle.

4. The liquid jet recording head as claimed in claim 1, further comprising a set of electrodes which are formed by pattern forming to electrically connect with said plurality of heating elements, said set of electrodes constituting a part of said drive control mechanism.

5. A liquid jet recording head for generating bubbles in a writing liquid and discharging droplets of the writing liquid to a recording sheet in a printer, said printer having a drive control mechanism for driving the liquid jet recording head, said liquid jet recording head comprising:

an orifice through which the writing liquid is discharge;

a liquid chamber having a liquid discharge path leading to the orifice, said liquid chamber communicating with said liquid discharge path and said orifice to allow the writing liquid within the liquid chamber to be discharged from the orifice through said liquid discharge path; and a plurality of heating elements provided within the liquid chamber for generating thermal energy to produce bubbles in the writing liquid, said heating elements having a heat transmitting surface which is perpendicular to said liquid discharge path, said heating elements having different thermal energy generating capacities and having different distances from the center of said orifice, said heating elements being provided corresponding to said single orifice and arranged in a plane within said energy transmitting surface, each of said heating elements being driven independently of the others by the drive control mechanism to generate independently thermal energy used for discharging the writing liquid, selected combinations of said plurality of heating elements being selectively driven so that various sizes of droplets of the writing liquid are discharged through said orifice.

6. The liquid jet recording head as claimed in claim 5, wherein said heating elements have generally rectangular shapes and are arranged on said energy transmitting surface generally in two or more rows and two or more columns.

7. The liquid jet recording head as claimed in claim 5, wherein said heating elements are arranged on said energy transmitting surface in the form of segments of a circle.

8. The liquid jet recording head as claimed in claim 5, further comprising a set of electrodes which ar formed by pattern forming to electrically connect with said plurality of heating elements, said set of electrodes constituting a part of said drive control mechanism.

* * * * *